United States Patent [19]

Tedden

[11] 3,951,158

[45] Apr. 20, 1976

[54] APPARATUS FOR AUTOMATICALLY CLEANING REUSABLE FOODSTUFF CONTAINERS WITH REDUCED QUANTITIES OF FRESH WATER AND CHEMICALS

[76] Inventor: Erhard Tedden, D-423 Wesel 13, Am Moorbusch 1, Germany

[22] Filed: Apr. 7, 1975

[21] Appl. No.: 565,683

[52] U.S. Cl. ..... 134/60; 134/73; 134/108; 134/170

[51] Int. Cl.[2] ..... B08B 3/02; B08B 9/08

[58] Field of Search ..... 134/60, 73, 105, 107, 134/108, 109, 170

[56] References Cited

UNITED STATES PATENTS

| | | | |
|---|---|---|---|
| 2,617,435 | 11/1952 | Kessler | 134/108 X |
| 2,774,361 | 12/1956 | Ladewig | 134/108 X |
| 3,598,131 | 8/1971 | Weihe, Jr. | 134/107 |

*Primary Examiner*—Robert L. Bleutge
*Attorney, Agent, or Firm*—Roland T. Bryan

[57] ABSTRACT

An automatic cleaning machine for cleaning reusable foodstuff containers, such as bottles, cans or boxes, wherein the machine is of the type containing successive liquid cleaning and rinsing baths or stages, and is characterized by apparatus for supplying and circulating liquid in the machine which improves waste water composition. Steam derived from an evaporator holding soft water is passed through a heat exchanger to heat washing liquid in the machine. The condensate from the heat exchanger is supplied to a first rinse water tank or container for use as rinsing water immediately following the last cleaning solution stage and before the final fresh water rinse. Preferably the first rinse water container has two chambers, a second chamber receiving the condensate and storing the excess, and a first chamber receiving overflow from the second chamber. Rinse water from the first chamber, comprising condensate and cleaning agent rinsed from the treated foodstuff containers, is returned to the evaporator as feed water for reheating. The progressively concentrated evaporator water is adjustably fed back to the cleaning bath to restore cleaning agent lost or carried away to the rinsing stages on the foodstuff containers.

4 Claims, 3 Drawing Figures

APPARATUS FOR AUTOMATICALLY CLEANING REUSABLE FOODSTUFF CONTAINERS WITH REDUCED QUANTITIES OF FRESH WATER AND CHEMICALS

REFERENCE TO PRIOR APPLICATION

This application is a continuation-in-part application of application Ser. No. 299,052, entitled "Method for Automatically Cleaning Reusable Foodstuff Containers with Reduced Quantities of Fresh Water and Chemicals," which was filed Oct. 19, 1972, now U.S. Pat. No. 3,899,348.

BACKGROUND OF THE INVENTION

1. Field of the Invention

This invention relates to automatic cleaning machines for cleaning reusable foodstuff containers, and more particularly, to apparatus for supplying and circulating liquid in machines of the type having successive liquid cleaning or rinsing baths or stages for application of cleaning agent and rinse to foodstuff containers.

2. Description of the Prior Art

For the cleaning of reusable foodstuff containers of all kinds, such as bottles, cans or other metal parts, automatic cleaning machines are employed. In such machines, the generally cold container stock to be cleaned is treated in several stages and/or baths at selected temperatures and with suitable concentration of cleaning agents. Generally, these stages include a preliminary cleaning stage, a main cleaning stage and a subsequent rinsing stage.

The temperatures, the types of chemical cleaning agents used and their concentration may vary between the different stages. The rinsing stage is usually carried out by rinsing the container stock in clean water. When cleaning containers subsequently to be used for foodstuffs, fresh water is principally used for the last rinsing stage in the cleaning process. The fresh water supplied to the cleaning machine, after being used in various other individual stages of the cleaning process, is then fed as waste water to a drainage system. While the fresh water is passing through the machine in a direction opposite to the direction of movement of the container stock, dirt is absorbed by the cleaning-agent solution and is admixed with the counter-flowing fresh water.

Cleaning machines preferably are designed to be as small as possible and to provide for the highest possible output per hour and thus attain optimal exploitation of the space available for the installation of the machine.

Attempts have been made to reduce the quantity of fresh water and thereby the quantity of waste water used to operate cleaning machines. However, with a reduction of the fresh water quantities on the one hand, but with a faster transit time of the stock to be cleaned on the other hand, there results an increased degree of contamination of the waste water. Moreover, because the use of less water leads to longer persistance of the mixture of cleaning agent and water in the cleaning machine, more time remains for reaction, for example, the precipitation of solids. The equilibrium, which occurs after a certain period of operation of the cleaning machine, between the quantity of fresh water supplied and the quantity of the cleaning agent solution being carried away, necessarily sets itself at a higher level of the salt mass and hence concentration of the mixture, so that the total quantity of the waste water becomes somewhat smaller but its composition less favorable.

When the container stock to be cleaned is transferred from, for example, an alkaline solution in the first water bath, according to experience with the given temperatures and with use of hard water, there occurs a more or less strong petrifaction due to calcification. With inadequate servicing, this fact rapidly leads to faults in the cleaning or rinsing process. It is known that as a result of deposits, heating devices lose their normal facility for heat transmission, vats become encrusted, spray tubes become clogged, and pumps shift in their settings and fall off in performance, etc. All these result in impairment of the cleaning processes.

To prevent or to reduce too extensive precipitation, inhibiting materials, for example complex formers, are frequently added. This procedure, however, does not always successfully achieve operational requirements, when economically tolerable quantities of these chemicals are employed. Moreover, the waste water is thereby additionally contaminated if only to a small extent.

In some cases, softened water is employed to eliminate the risk of precipitation. In this procedure, the salt content of the fresh water is practically unaltered and thus remains in the waste water. The costs of preparation however are particularly high with very hard water.

A genuine saving in fresh water has expectation of success only when the container stock to be cleaned, after being cleaned in the cleaning agent solution and after the first of several stages of rinsing, has the degree of cleanliness of the fresh water supplied to the cleaning machine. This presupposes, however, that, prior to the last washing stage in the cleaning agent and therefore before the addition of fresh water from the main network, relatively clean water is available. If this is not the case, then a larger quantity of fresh water is required to be supplied from the main network for rinsing out the preceding relatively dirty water.

Particularly when the container stock is to be used for foodstuffs, a guaranteed degree of cleanliness in a chemical as well as in a bacteriological respect must be attained. The growth or the possibility of growth of microorganisms can be enhanced with a strong tendency to "fur" formation, hard precipitation, and formation of sediment in the vats and containers of the cleaning machine, which have water applied to them and also in the only sporadically wetted inner parts of the cleaning machines. This requires additional disinfecting means in the stage concerned to keep the germ count in the water or the mixture of water and cleaning agent at a tolerable level.

The waste water of the machine, which flows away enriched with materials and more or less strongly contaminated by being mixed with remnants of cleaning means on rinsing, frequently provokes disturbances in the sewage network, because here strong precipitation depending on composition and time can likewise occur and cause constrictions of the cross-section, clogging and sometimes even complete closing up of the drainage pipes.

SUMMARY OF THE INVENTION

Objects of the present invention are to provide apparatus for supplying and circulating liquid in a cleaning machine which results in the saving of fresh water, with a concommitant reduction in waste water quantities, for the improvement of the waste water composition, and for better utilization of the cleaning chemicals.

According to the principal aspects of the invention, the apparatus for supplying and circulating liquid in a cleaning machine of the type having successive cleaning and rinsing stages, utilizes steam derived from an evaporator and passed to a heat exchanger in the machine to heat washing liquid in the machine. Condensate from the heat exchanger is supplied to a first rinse water container for rinsing the foodstuff containers, and then is fed back to the evaporator as feed water for renewed evaporation. Cleaning agent returned to the evaporator with the rinse water is fed to cleaning stages in the machine to supplant cleaning agent lost or carried on the foodstuff containers. In accordance with the apparatus of the present invention, less fresh water is required for thinning the cleaning agent and for carrying out the cleaning operations of the machine, and less waste water, having a more favorable composition, is produced.

DESCRIPTION OF DRAWINGS

Objects, aspects and advantages of the present invention will be pointed out in, or apparent from, the detailed description hereinbelow, considered together with the following drawings, in which.

DESCRIPTION OF THE PREFERRED EMBODIMENT

Figure 1A:
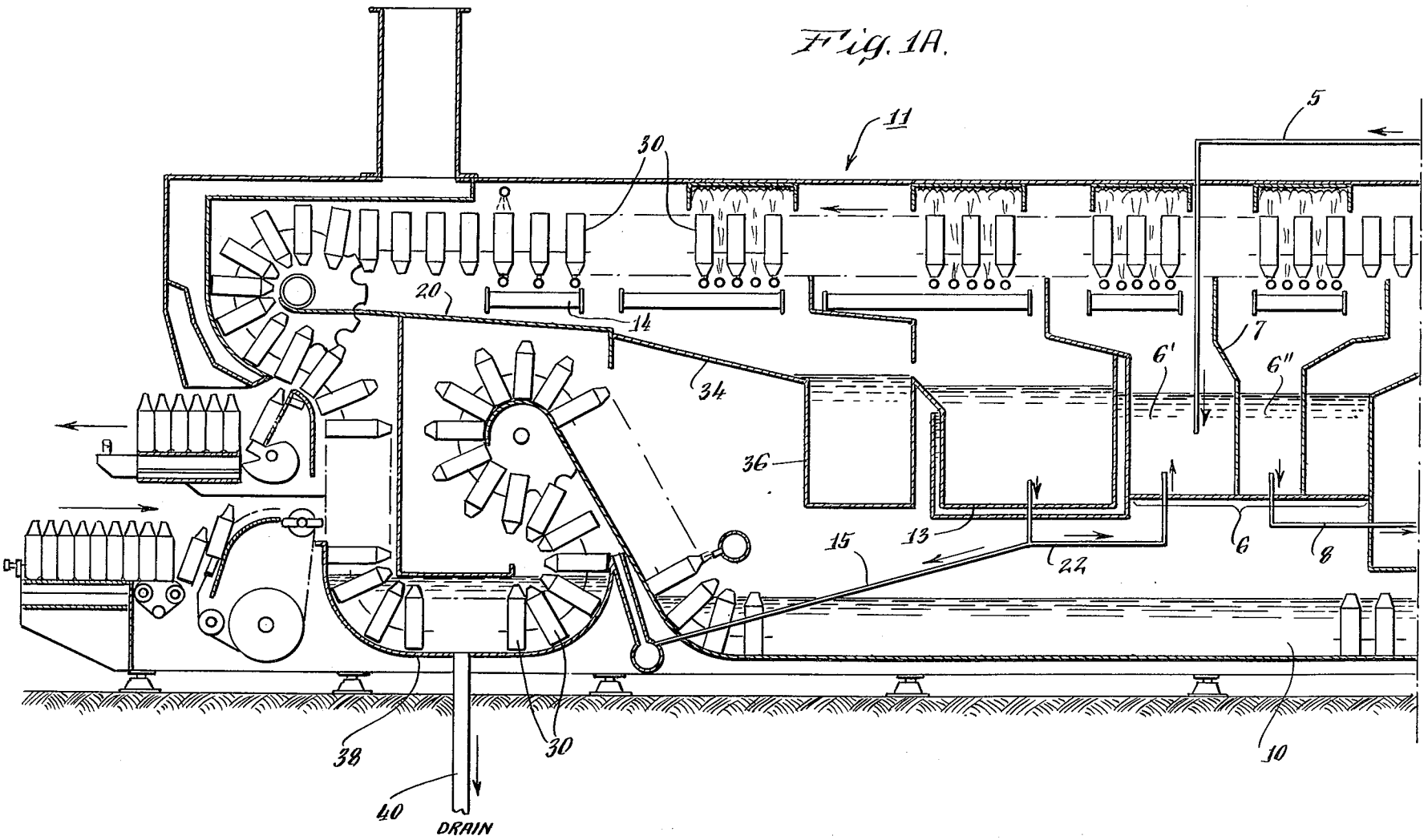
FIGS. 1A and 1B illustrate the left hand and the right hand portions, respectively, of the apparatus embodying the present invention.
Figure 2:
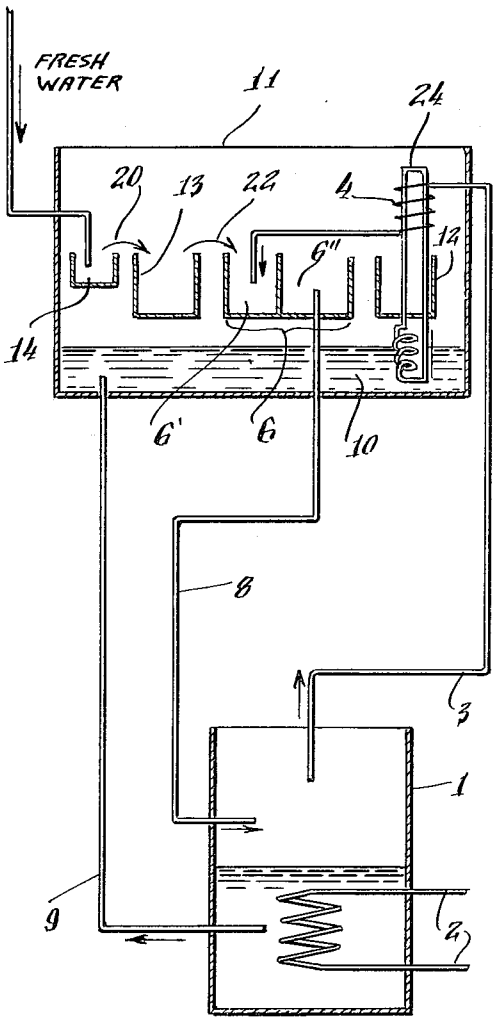
FIG. 2 is a schematic representation of a portion of an automatic cleaning machine for cleaning reusable foodstuff containers, showing various cleaning and rinsing apparatus for the supply and circulation of liquid therein according to the invention, but omitting the well-known foodstuff container handling, immersing, moving and/or spraying devices found in such machines.
Figure 1B:
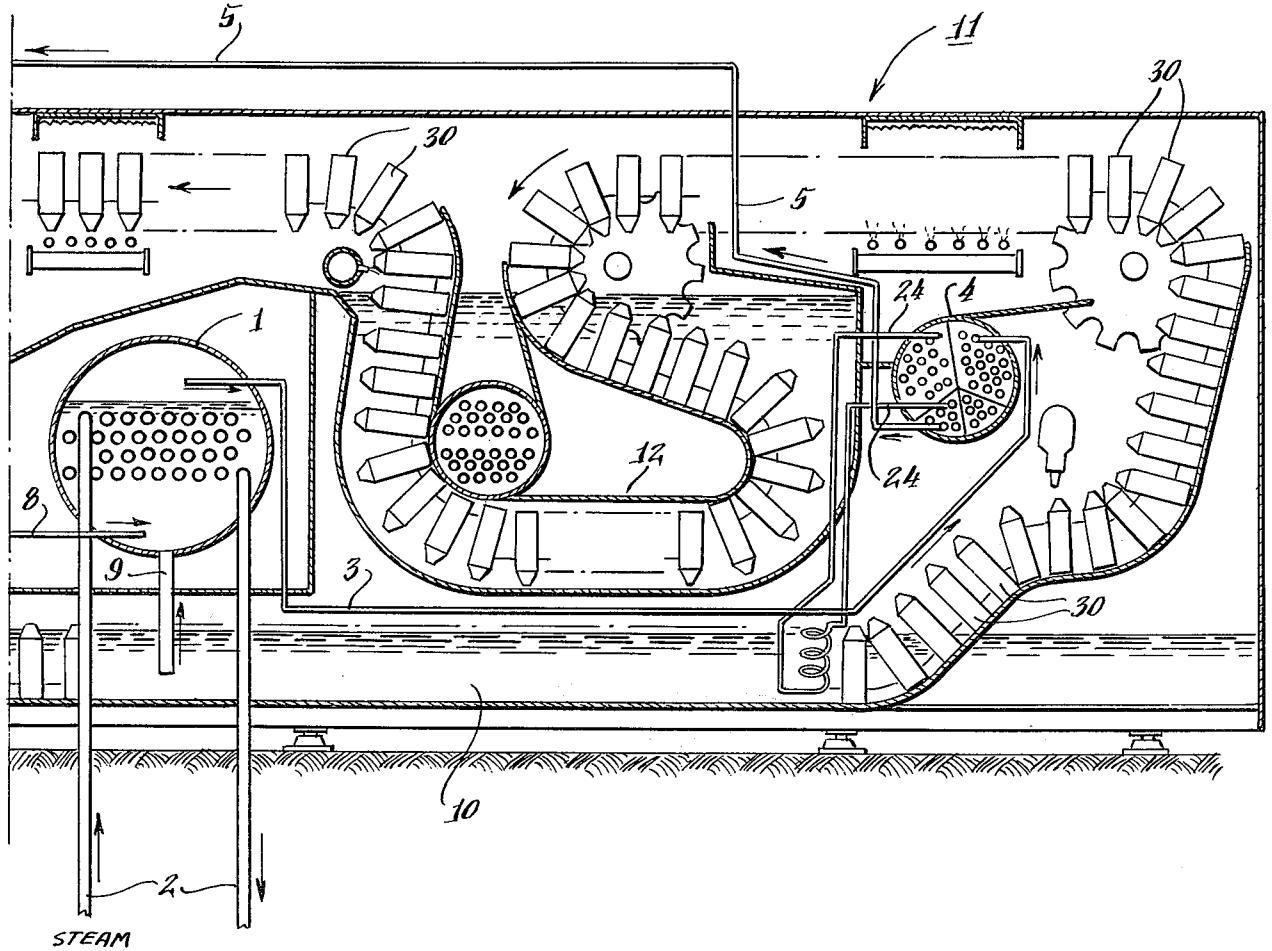

FIGS. 1A, 1B and 2 of the drawings illustrate a cleaning machine 11 in which liquid is supplied and circulated in accordance with the present invention. For purposes of convenience in illustrating, the left portion of the machine is shown in FIG. 1A and the right portion in FIG. 1B. Foodstuff containers 30, enter the machine from the left, travel through a main liquid container 10, and then travel from right to left through successive baths or stages in the machine. Taken in the direction of movement of bottles through the cleaning machine 11, these successive baths or stages include a last cleaning solution container 12, followed by a first rinse water container 6, followed by a second rinse water container 13. Fresh water is fed via the container 14 into the cleaning machine 11; the water running over from the container 14, and the cold water spray container 32 falling into the apron 20 and into the cold water holding tank 36, from which overflow passes into the second water container 13 from which excess water flows through a duct 15 into the pre-wash tank 38 from whence excess water may be passed through duct 40 to an associated drainage system (not shown).

An evaporator 1, preferably initially containing condensed or softened water, is heated by the passage of steam or hot water through a coiled heater pipe 2. Steam generated in the evaporator is passed via a duct 3 to a heat exchanger 4 of the cleaning machine 11. Heat liberated from the heat exchanger 4 is used to heat washing liquid which is passed through pipe 24 in the cleaning machine 11 passing through the ducts 40, 42. The condensate from the heat exchanger 4 flows via a condensate duct 5 to a chamber 6' in first rinse water container 6. Water flows over a dividing wall 7 into a further chamber 6'' in the first rinse water container. While in the first rinse water container 6, the condensate is used to rinse foodstuff containers. From the chamber 6'' water flows via a feed water duct 8 back to the evaporator 1.

The non-evaporated liquid in the evaporator 1, which contains cleaning agent rinsed from the foodstuff containers, is selectively fed as described below, via a sediment duct 9, to a main liquid container 10 in the cleaning machine 11 to restore cleaning agent lost or carried away on foodstuff containers. Such residual liquid from the evaporator may be fed to the cleaning stage container 12 in accordance with the quantity of fresh replacement water supplied to the machine.

The residual liquid in evaporator 1, which becomes concentrated cleaning agent, is fed back to container 10 to replace the cleaning agent solution carried away from container 10 by the foodstuff containers. Preferably, the residual liquid to evaporator 1 is fed back to container 10 in an amount equivalent to that quantity of cleaning agent solution carried away from container 10. Since the residual liquid in evaporator 1 contains cleaning agent, the container 10 regains a portion of the cleaning agent lost through being carried away. Thus, only quite small quantities of cleaning agent are ultimately carried away from the first rinse water container 6 into the second rinse water container 13 and thus a smaller quantity of fresh water is required from container 14 for thinning and carrying out the cleaning operations of the machine. The waste water also occurs in smaller quantity and more favorable composition than in arrangements known hitherto.

Thus, for heating the washing liquid in a cleaning machine, there is provided an evaporator arrangement which on the steam side is heated in a primary circuit and which acts on the cleaning machine 11 in a secondary circuit. The used steam or heating water is thereby not applied directly to the cleaning machine in a primary circuit as hitherto usual, but indirectly via an evaporator in a secondary circuit. The feed water for the evaporator is derived from a quantity of water present in a first rinse water container 6 in the cleaning machine. As stated above, it is preferable to use condensed or softened water for this purpose.

The steam generated in the evaporator 1, after passing through the heat exchanger 4 of the cleaning machine and/or other heat exchange devices (not shown) is condensed and fed into the first rinse water container 6 following the last cleaning agent solution container 12. This condensation is used as rinsing water for rinsing residual quantities of the cleaning agent and any remaining dirt adhering to the foodstuff container stock to be cleaned. The use of the "soft" condensate for this purpose prevents the formation of "fur" which occurs when "hard" water is used.

Preferably, as described, liquid comprising a mixture of condensate, cleaning agent and dirt is fed back through feed water duct 8 to the evaporator 1 as feed water for renewed evaporation. The water — or in the course of the process, the mixture of water and cleaning agent — present in the first water container 6 is again evaporated in the evaporator and the steam is again fed to the heat exchanger of the cleaning machine for heating the solution contained in the last cleaning container 12. The condensate is again fed back to the first rinse water container 6 of the cleaning machine and is there circulated for rinsing by means of a pump. Accordingly, the solution in the evaporator 1 becomes progressively concentrated. From the progressively concentrated evaporator water, an adjustable quantity is again fed back as "concentrate" to the cleaning means bath 10. In this, this quantity must be adjusted in dependence upon quantities of cleaning agent carried in and carried away, evaporation in the atmosphere and other operational data. Lost quantities of water are restored by being fed from the second water container 13 to the first water container 6 through the duct 22.

As described above, the first rinse water container 6 is divided by volume into first and second chambers 6' and 6'', the incoming condensate being fed into the second chamber 6' and circulated therein, while the excess is fed into the first chamber 6'' of the first water container. The first chamber 6'' is arranged after the last container 12 for the cleaning agent and the second chamber 6' after this first separation within the first rinse water container 6. In this, the first chamber 6'' is to be divided by volume according to the given relationships; for the second chamber 6' the same quantity should be chosen as it occurs in the condensate, i.e. the quantity of condensate occurring per unit of container stock to be cleaned and unit of time should determine the size by volume of the second chamber 6' of the first rinse water container 6. Thereby, this second chamber 6' of the first rinse water container 6 is exclusively provided with condensate and the excess quantities are accommodated in the first chamber 6'' of the first rinse water container 6.

When running in the installation, it is important to create the optimal volume relationships of the water containers in dependence upon the achieved loading per hour of the stock to be cleaned. Other than is the case in the known installations, greater volumes are valid for the first water container of the cleaning machine in the case of the arrangement embodying the invention, when the so-called intermediate spraying is presupposed as given. It is also important, that apart from the naturally occurring carrying over from one container into the other (illustrated by an arrow 22), no connection exists between the first and the second rinse water containers 6 and 13, if one disregards the above-described connection to the evaporator, in order to equalize the loss quantities of the first water container from the second water container.

As has already been mentioned, it is preferable to use condensate or softened water for the initial filling of the first water container, when soft water is not already supplied from the water main network, in order in case of the use of alkaline solutions, which are carried away, to avoid a hard precipitation and to reduce in the evaporator the formation of sludge or possibility of incrustation.

As noted above, FIG. 2 illustrates in schematic form several of the components comprising the embodiment of this invention shown in FIGS. 1A and 1B, and their functional interrelationships.

Although a specific embodiment of the invention has been disclosed herein in detail, it is to be understood that this is for the purpose of illustrating the invention, and should not be construed as necessarily limiting the scope of the invention, since it is apparent that many changes can be made to the disclosed methods and structures by those skilled in the art to suit particular applications.

I claim:

1. Apparatus for supplying and circulating liquid in an automatic cleaning machine for reusable foodstuff containers, said machine being of the type containing successive liquid cleaning and rinsing baths or stages for application of cleaning agent and rinse to the foodstuff containers traveling through the machine, said apparatus comprising:

evaporator means for heating liquid to form steam;

a heat exchanger in the machine;

duct means for passing the steam to the heat exchanger to liberate heat for heating washing liquid in the machine and to form condensate; and duct means for passing the condensate to a first rinse water contained in the machine, said machine rinsing the foodstuff containers with the condensate in the first rinse water container.

2. An apparatus for supplying and circulating liquid as claimed in claim 1 further comprising:

duct means for passing the liquid in the first rinse water container, including condensate and cleaning agent rinsed from the foodstuff containers, to the evaporator as feed water for renewed evaporation.

3. An apparatus for supplying and circulating liquid as claimed in claim 2 further comprising:

duct means for passing the residual liquid in the evaporator, which includes cleaning agent rinsed from the foodstuff containers in the first rinse water container, back to a cleaning stage container in the machine to restore cleaning agent carried away therefrom on the foodstuff containers, thereby reducing the amount of cleaning agent needed for cleaning and later discharged as waste.

4. An apparatus for supplying and circulating liquid as claimed in claim 2 wherein the first rinse water container has first and second chambers, and wherein the condensate from the heat exchanger is fed into the second chamber and wherein excess liquid feeds therefrom into the first chamber and is fed therefrom back into the evaporator.

* * * * *